US011215368B2

(12) United States Patent
Deng et al.

(10) Patent No.: US 11,215,368 B2
(45) Date of Patent: Jan. 4, 2022

(54) RANGE HOOD

(71) Applicants: GREE ELECTRIC APPLIANCES (WUHAN) CO., LTD, Hubei (CN); GREE ELECTRIC APPLIANCES, INC. OF ZHUHAI, Guangdong (CN)

(72) Inventors: Hai Deng, Zhuhai (CN); Xiaodi Hu, Zhuhai (CN); Luohuo Ding, Zhuhai (CN); Ning Xu, Zhuhai (CN); Hong Wang, Zhuhai (CN); Min Liu, Zhuhai (CN)

(73) Assignees: GREE ELECTRIC APPLIANCES (WUHAN) CO., LTD, Hubei (CN); GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 0 days.

(21) Appl. No.: 16/631,129

(22) PCT Filed: Dec. 27, 2017

(86) PCT No.: PCT/CN2017/118862
§ 371 (c)(1),
(2) Date: Jan. 14, 2020

(87) PCT Pub. No.: WO2019/119488
PCT Pub. Date: Jun. 27, 2019

(65) Prior Publication Data

US 2020/0340682 A1 Oct. 29, 2020

(30) Foreign Application Priority Data

Dec. 19, 2017 (CN) ..... 201711370890.5

(51) Int. Cl.
*F24C 15/20* (2006.01)

(52) U.S. Cl.
CPC ..... *F24C 15/2071* (2013.01)

(58) Field of Classification Search
CPC .. F24C 15/20; F24C 15/2071; F24C 15/2092; F24C 15/2035
See application file for complete search history.

(56) References Cited

U.S. PATENT DOCUMENTS 7,699,051 B2 * 4/2010 Gagas ..... F24C 15/2028 126/299 D
7,823,580 B2 * 11/2010 Sinur ..... F24C 15/2021 126/299 R
10,969,115 B2 * 4/2021 Xu ..... F24C 15/2035

FOREIGN PATENT DOCUMENTS

CN 201028673 Y 2/2008
CN 203052790 U 7/2013
(Continued)

OTHER PUBLICATIONS

Office Action for Japanese Application No. 2020-506174 dated Mar. 30, 2021 (4 pages).
(Continued)

*Primary Examiner* — Edelmira Bosques
*Assistant Examiner* — Nikhil P Mashruwala
(74) *Attorney, Agent, or Firm* — Brandon V. Zuniga; James R. Gourley; Carstens & Cahoon, LLP

(57) ABSTRACT

A range hood, including a housing with an opening at one side and a fume inlet panel component which is provided on the housing, the fume inlet panel component is provided at the opening of the housing, a fan is provided in an inner cavity of the housing, the fume inlet panel component is configured in such a way that at least a region of the opening of the housing corresponding to the fan can be opened, and the fan can be removed from the region. When the fan and an inner surface of a volute need to be cleaned, a user can conveniently remove the fan from one side of the fume inlet panel component and clean the removed fan and access an interior of the volute to clean an inside surface of the volute,
(Continued)

ensuring extraction capability and increasing a service life of the range hood.

18 Claims, 9 Drawing Sheets

(56) References Cited

FOREIGN PATENT DOCUMENTS

| | | | | | |
|---|---|---|---|---|---|
| CN | 203177259 | U | | 9/2013 | |
| CN | 203549962 | U | * | 4/2014 | ..... F24C 15/20 |
| CN | 203549962 | U | | 4/2014 | |
| CN | 204006225 | U | * | 12/2014 | ..... F24C 15/20 |
| CN | 204006225 | U | | 12/2014 | |
| CN | 204128031 | U | | 1/2015 | |
| CN | 204285557 | U | | 4/2015 | |
| CN | 107449007 | A | * | 12/2017 | ..... F24C 15/20 |
| CN | 110207214 | A | * | 9/2019 | ..... F24C 15/2035 |
| CN | 110631065 | A | * | 12/2019 | ..... F24C 15/2035 |
| DE | 202013101930 | U1 | | 5/2013 | |
| JP | H0625786 | U | | 4/1994 | |
| JP | H09236293 | A | | 9/1997 | |
| JP | 2014114974 | A | | 6/2014 | |
| WO | WO-2019186289 | A1 | * | 10/2019 | ..... F24C 15/2092 |

OTHER PUBLICATIONS

Office Action for Korean Application No. 10-2020-7003996 dated Feb. 4, 2021 (7 pages).
International Search Report for Application No. PCT/CN2017/118862 dated Sep. 21, 2018 (5 pages).

* cited by examiner

RANGE HOOD

CROSS-REFERENCE TO RELATED DISCLOSURE

This application is a U.S. National Stage of International Application No. PCT/CN2017/118862, filed on Dec. 27, 2017, and published as WO 2019/119488 on Jun. 27, 2019, which claims priority to Chinese Patent Application No. 201711370890.5, filed on Dec. 19, 2017, and titled "RANGE HOOD". Each application, publication, and patent listed in this paragraph are hereby incorporated by reference in their entireties.

TECHNICAL FIELD

The present disclosure relates to the field of kitchen equipment, and in particular to a range hood.

BACKGROUND

A Kitchen is a site for cooking delicious food. However, cooking fume has been a problem disturbing users for a long time. Lateral-suction range hoods have become a popular option for the users due to their "close extraction". However, the existing range hoods are not able to be cleaned thoroughly, which affects the extraction capacity of the range hoods. The cleaning of a range hood is not only referred to cleaning oil contamination on surfaces of panels, and the cleaning of the fan and the interior of the volute is the crux for improving the effect of extracting fume of the range hood. It is inconvenient to detach and clean the fan and the volute of the existing range hood. The fan and the volute can be detached and cleaned only when the whole machine is disassembled. Therefore, only a few users will detach and clean the range hood by themselves due to the lack of knowledge of assembling the range hoods and the related electrical safety. Required to be done by housekeeping experts, cleaning the fan and the interior of volute is costly, time-consuming and laborious.

SUMMARY

In view of this, an objective of the present disclosure is to provide a range hood that facilitates detaching the fan, thereby facilitating cleaning the fan and the volute.

To achieve the objective above, the present disclosure provides the following technical solutions:

A range hood includes a housing having an opening, and a fume inlet panel component arranged on the housing; the fume inlet panel component is arranged at the opening of the housing; a fan is arranged in an inner cavity of the housing; and the fume inlet panel component is configured to enable at least a region of the opening of the housing, which corresponds to the fan, to open, so that the fan can be removed from the region.

In an embodiment, the fume inlet panel component comprises a plurality of panels, and at least a panel of the plurality of panels, which corresponds to a position of the fan, is configured to be an openable structure.

In an embodiment, the openable structure is a detachable structure, or the openable structure is a turnable structure, or the openable structure is a slideable structure.

In an embodiment, the range hood is a lateral-suction range hood; the plurality of panels comprises an upper panel, a lower panel, and a fume deflector located between the upper panel and the lower panel; the upper panel is configured to be an openable structure; and the fume deflector is configured to be a detachable structure.

In an embodiment, the fume deflector has an opened state and a closed state; in the opened state, compared with an upper end of the fume deflector, a lower end of the fume deflector is farther away from the housing; and in the closed state, the fume deflector, the upper panel and the lower panel are pieced together to form a flat outer surface of the fume inlet panel component.

In an embodiment, a fume gathering cover is arranged at the opening of the housing; the fume gathering cover is disposed on an inner side of the fume inlet panel component; and the upper panel and/or the fume deflector are/is connected to the fume gathering cover.

In an embodiment, the upper panel is connected to the fume gathering cover by a first connection member; the first connection member comprises a first connection portion and a second connection portion; the first connection portion is connected to an inside surface of the upper panel; the second connection portion is connected to the fume gathering cover; and the fume deflector is connected to the fume gathering cover by a second connection member; the second connection member comprises a third connection portion and a fourth connection portion; the third connection portion is connected to an inside surface of the fume deflector; and the fourth connection portion is connected to the fume gathering cover.

In an embodiment, the first connection portion is rigidly connected to the upper panel by bonding;

the second connection portion is rigidly connected to the fume gathering cover by a fastener;

the third connection portion is rigidly connected to the fume deflector by bonding; and the fourth connection portion is rigidly connected to the fume gathering cover by a fastener.

In an embodiment, a retractable support is arranged on the fume gathering cover; the retractable support is provided with a slot; the fourth connection portion is inserted in the slot and is rigidly connected to the retractable support by a fastener.

In an embodiment, the first connection portion and the second connection portion are both plate-shaped; the first connection portion is parallel to the second connection portion; and the first connection portion and the second connection portion are connected by a connection plate;

and the third connection portion and the fourth connection portion are both plate-shaped; and the fourth connection portion is connected to an edge of the third connection portion.

In an embodiment, the fume gathering cover is provided with an air inlet corresponding to a position of the fan, and an edge of the air inlet is located outside of the fan in radial directions of the fan.

In an embodiment, the range hood further comprises a first filtration structure, and the first filtration structure is arranged on the fume gathering cover and covers the air inlet.

Preferably, an inner recess recessed in a direction away from the fume inlet panel component is disposed on the fume gathering cover; the air inlet is arranged on an inner bottom of the inner recess; and the first filtration structure is received in the inner recess.

Preferably, the range hood further comprises a second filtration structure; the inner recess comprises a first portion corresponding to a position of an upper half of the fan, and a second portion corresponding to a position of a lower half of the fan and the second filtration structure; a side wall of the first portion forms a shape fitting a peripheral of the fan in the radial directions; a side wall of the second portion forms a shape fitting an edge of the second filtration structure; and the second filtration structure is arranged on the second portion.

In an embodiment, when the upper panel is arranged on the fume gathering cover, the upper panel covers the first portion.

In an embodiment, a hinge joint is formed between an edge of the upper panel and the fume gathering cover, or formed between an edge of the upper panel and the housing.

In an embodiment, the range hood further comprises a driving device configured to drive the fan; an end of the fan, which is away from the fume inlet panel component, is provided with an end member; the driving device is connected to the end member by a fastener; and the fastener is configured to be detachable from a side of the end member, which is proximate to the fume inlet panel component.

In an embodiment, the upper panel is connected to the fume gathering cover by a first connection member; the first connection member comprises a first connection portion and a second connection portion; the first connection portion is connected to an inside surface of the upper panel; the second connection portion is connected to the fume gathering cover; or the fume deflector is connected to the fume gathering cover by a second connection member; the second connection member comprises a third connection portion and a fourth connection portion; the third connection portion is connected to an inside surface of the fume deflector; and the fourth connection portion is connected to the fume gathering cover.

In an embodiment, the first connection portion is rigidly connected to the upper panel by bonding; or the second connection portion is rigidly connected to the fume gathering cover by a fastener; or the third connection portion is rigidly connected to the fume deflector by bonding; or the fourth connection portion is rigidly connected to the fume gathering cover by a fastener.

In an embodiment, the first connection portion and the second connection portion are both plate-shaped; the first connection portion is parallel to the second connection portion; and the first connection portion and the second connection portion are connected by a connection plate; or the third connection portion and the fourth connection portion are both plate-shaped; and the fourth connection portion is connected to an edge of the third connection portion.

The fume inlet panel component of the range hood provided in the present disclosure is configured to enable the region of the opening of the housing, which is corresponding to the fan, to be opened. Therefore, when the fan 3 and the inner side wall of the volute need to be cleaned by the user, the user is only required to open the fume inlet panel component, then the fan can be easily removed from the side where the smoke inlet panel component is located, thereby facilitating the cleaning of the removed fan and the cleaning of the inner side wall of the volute by accessing the interior of the volute, thereby ensuring the extraction capacity of the range hood, and prolonging the service life of the range hood.

BRIEF DESCRIPTION OF THE DRAWINGS

In order to make the content of the present disclosure understood more easily and clearly, the present disclosure will be further described in detail below in combination with drawings and specific embodiments, wherein.

Figure 1:
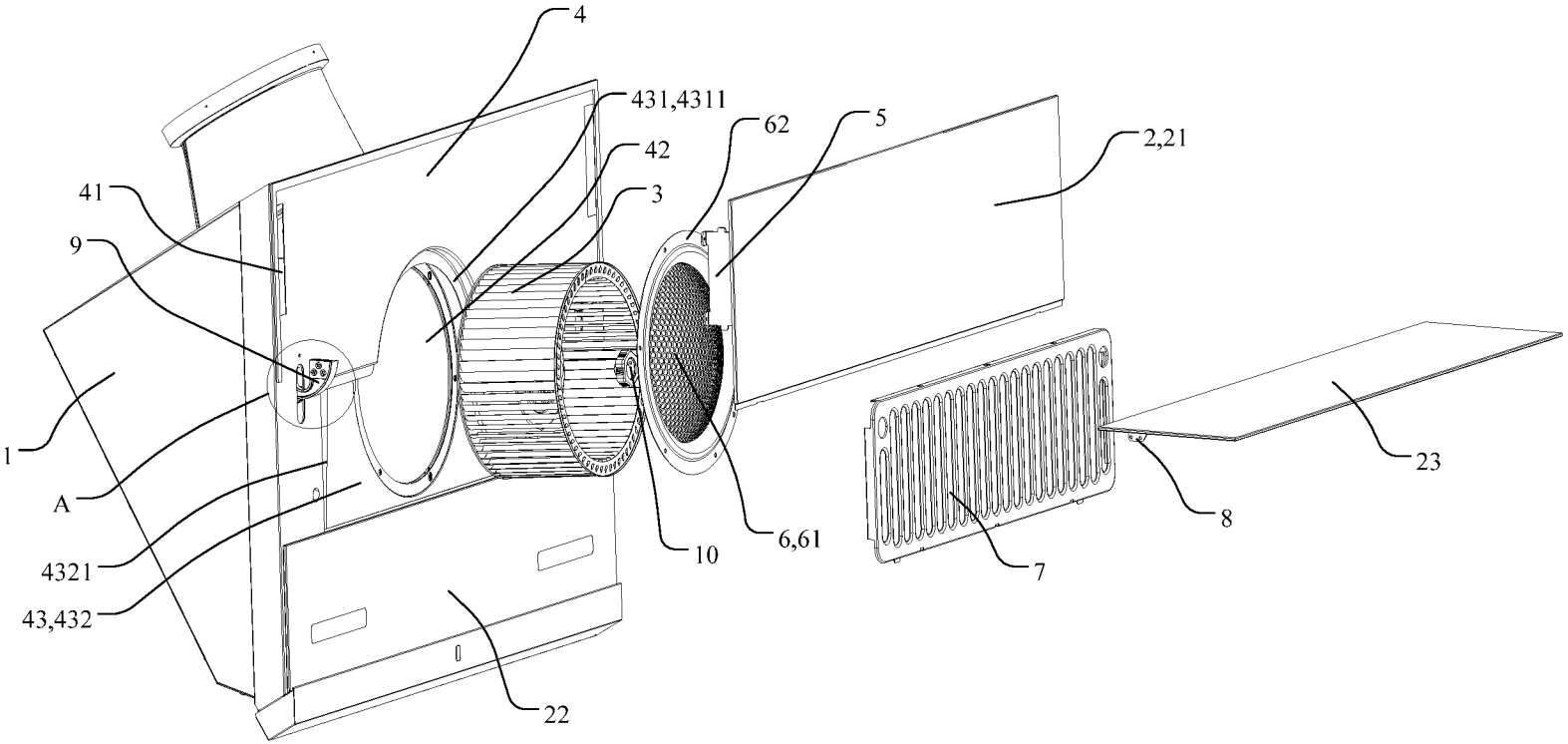
FIG. 1 is an exploded diagram of a range hood provided by an embodiment of the present disclosure.

In the drawings: 1—housing; 101—folded flange; 102—fastener; 2—fume inlet panel component; 21—upper panel; 22—lower panel; 23. fume deflector; 3—fan; 4—fume gathering cover; 41—opening; 42—air inlet; 43—inner recess; 431—first portion; 4311—side wall; 432—second portion; 4321—side wall; 44—ball catch; 45—frame structure; 5—first connection member; 51—first connection portion; 52—second connection portion; 53—connection plate; 6—first filtration structure; 61—oil filtering lattice; 62—installation rim; 7—second filtration structure; 8—second connection member; 81—third connection portion; 82—fourth connection portion; 9—retractable support; 91—slot; 92—fastener; 93—protrusion limit structure; 10—rotation nut; 11—hinge structure; 111—second hinge.

DETAILED DESCRIPTION OF THE EMBODIMENTS

The present disclosure is described below based on the embodiments, but the present disclosure should not be limited to these embodiments. In the following detailed description of the present disclosure, specific details are described in detail. The present disclosure without the description of these details can be understood appropriately by those skilled in the art. In order to avoid confusing the essence of the present disclosure, well-known methods, processes, procedures, and elements are not described herein in detail.

Moreover, those skilled in the art should understand that the drawings provided herein are merely for the illustrative purpose, and the drawings are not necessarily drawn to scale.

Unless explicitly defined in the context, the terms such as "comprise", "include" and the like in the whole description and claims should be construed as the meaning as containing, rather than as an exclusive or exhaustive meaning, i.e. as the meaning as "comprising, but not limited to".

It should be understood that, in the description of the present disclosure, the terms "first", "second" or the like are merely for the purpose of illustrating, rather than indicating or implying the relative importance. Moreover, in the description of the present disclosure, unless otherwise defined, the term "many" means two or more than two.

The terms "outer" and "inner" present in the present disclosure are understood with respect to the range hood itself. A side proximate to the interior of the range hood is "inner", and a side away from the interior of the range hood is "outer". The terms "upper" and "lower" present in the present disclosure are understood as orientations of the range hood in a regular operation, which can refer to the orientations shown in FIG. 1.

The present disclosure provides a range hood. As shown in FIG. 1, the range hood includes a housing 1 having an opening, and a fume inlet panel component 2 arranged on the housing 1. The fume inlet panel component 2 is arranged at the opening of the housing 1, and together with the housing 1, forms an inner cavity. The inner cavity is provided with a volute (not shown in the figures), a fan 3 disposed in the volute and a driving device (not shown in the figures) driving the fan 3 to rotate. The driving device can be, for example, a motor. The fume inlet panel component 2 is configured to enable a region of the opening of the housing 1, which corresponds to the fan 3, to open, so that the fan 3 can be removed from this region. Therefore, when the fan 3 and the inner side wall of the volute need to be cleaned by the user, the user is only required to open the fume inlet panel component 2, then the fan 3 can be easily removed from a side where the fume inlet panel component 2 is located, which makes it convenient for the user to clean the removed fan 2 and clean the inner side surface of the volute by accessing the interior of the volute, thereby ensuring the extraction capacity of the range hood and prolonging the service life of the range hood.

Figure 6:
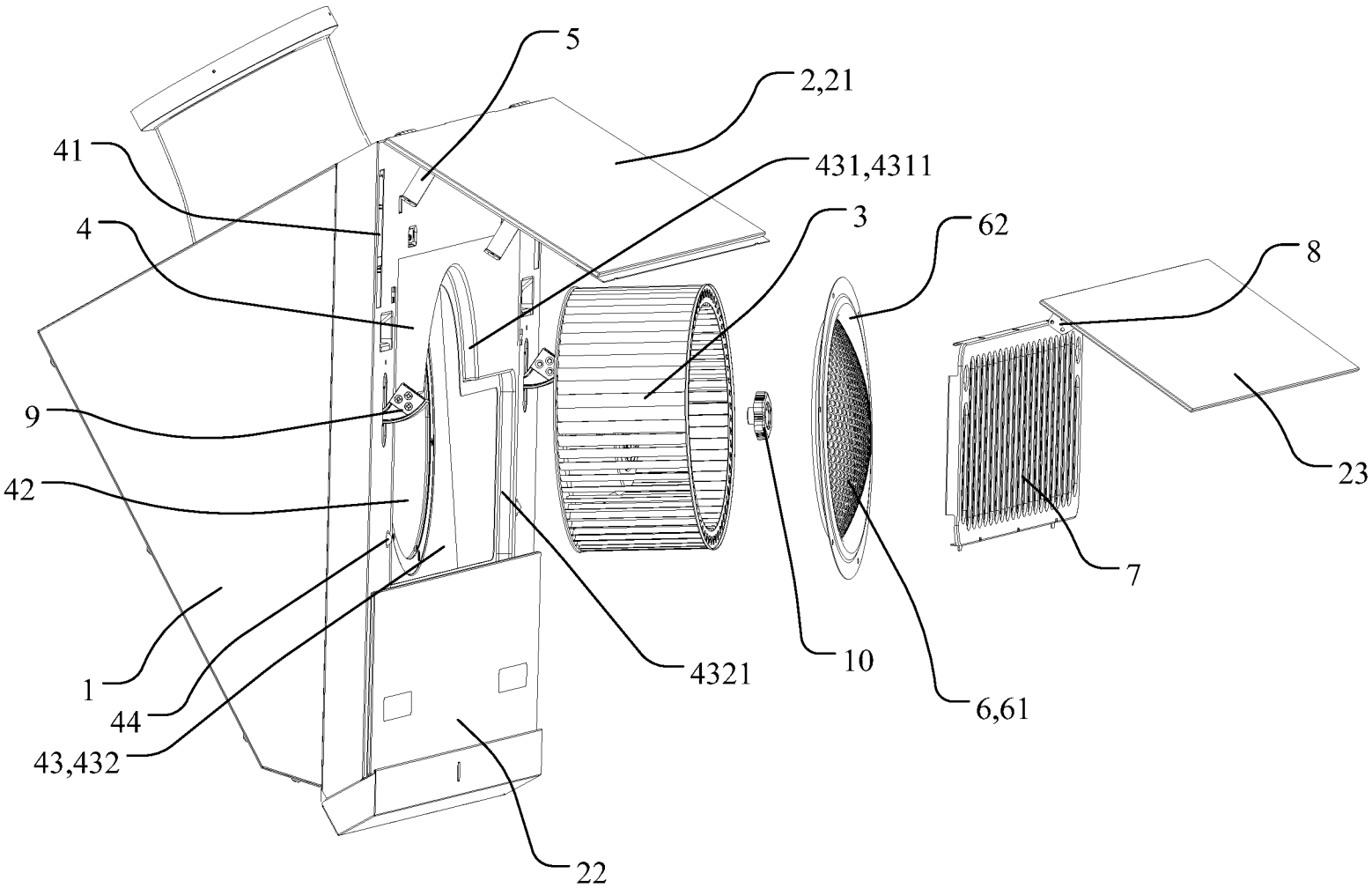
FIG. 6 is an exploded diagram of the range hood provided by another embodiment of the present disclosure.

The structure of the range hood provided by the present disclosure is applicable for various types of range hoods. Various embodiments will be described below by taking a lateral-suction range hood as an example. The fume inlet panel component 2, i.e. the panel component arranged at a side where the fume entering the range hood, includes a plurality of panels, wherein at least a panel corresponding to the position of the fan 3 is configured to be an openable structure. For example, in the embodiment as shown in FIG. 1, the plurality of panels include an upper panel 21, a lower panel and a fume deflector 23 located between the upper panel 21 and the lower panel 22. Since the upper panel 21 and the fume deflector 23 will affect the removal of the fan 3 during removing the fan 3 (which will be described in detail below), the upper panel 21 and the fume deflector 23 are configured to be openable structures. Further, since the fume deflector 23 is located at a middle position, the removal of the fan 3 will not be affected only when the fume deflector 23 is removed. Therefore, the fume deflector 23 is configured to be a detachable structure, that is, the fume deflector 23 can be detached from the range hood completely. Moreover, the upper panel 21 can be configured to be a detachable structure shown in FIG. 1, or to be a turnable structure shown in FIG. 6, or further to be an up and down slideable structure. These structures all can achieve the objective of facilitating the removal of the fan 3.

Figure 2:
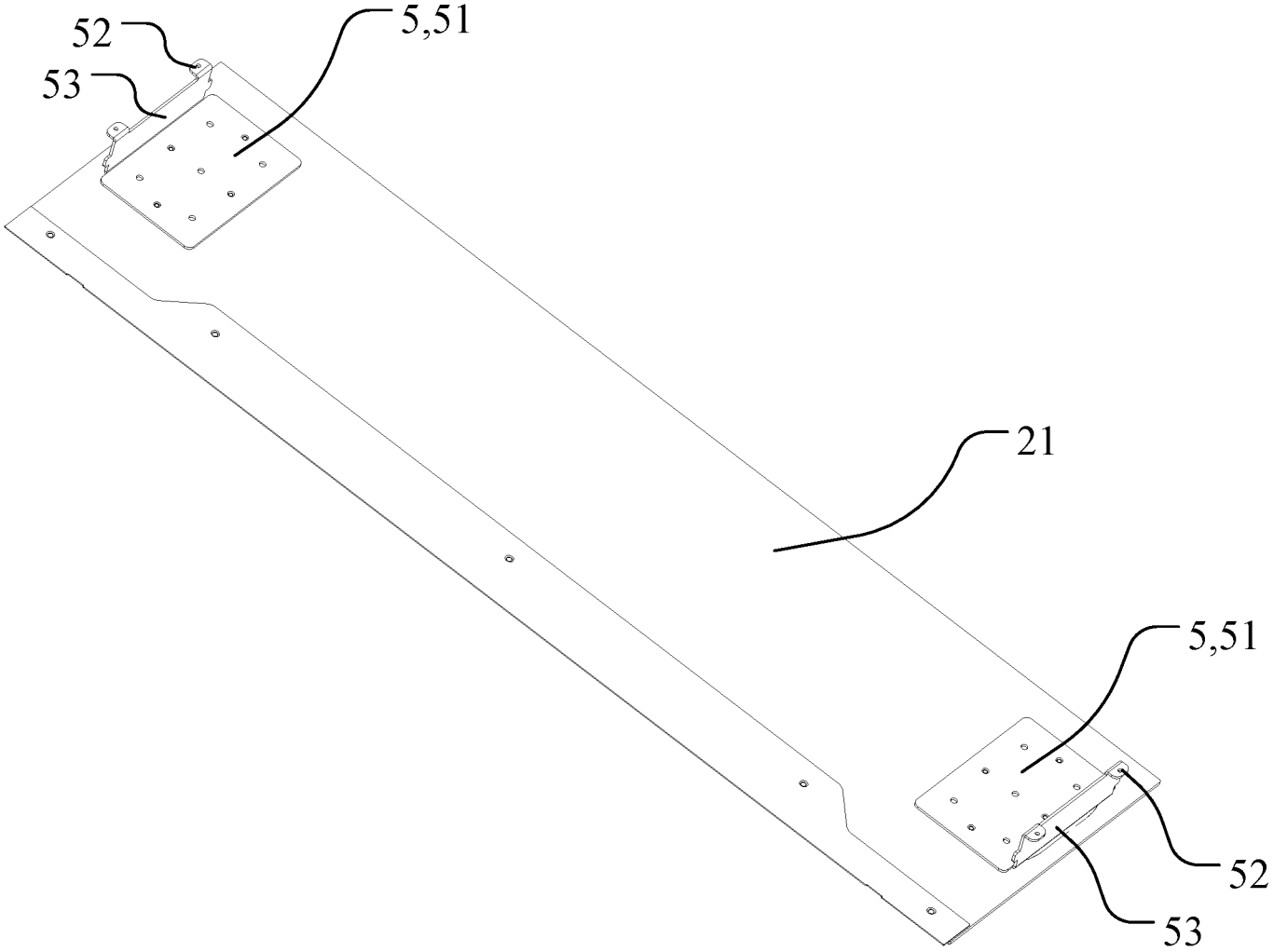
FIG. 2 is a schematic structural diagram illustrating an inside surface of an upper panel of the range hood shown in FIG. 1.

The fume inlet panel component 2 can be connected to the housing 1, or can be configured as shown in FIG. 1, a fume gathering cover 4 is provided at the opening of the housing 1 and disposed at the inner side of the fume inlet panel component 2, and the fume inlet panel component 2 is connected to the fume gathering cover 4. Specifically, in the embodiment as shown in FIG. 1, the upper panel 21 is connected to the fume gathering cover 4 by a first connection member 5. As shown in FIG. 2, the first connection member 5 includes a first connection portion 51 and a second connection portion 52. The first connection portion 51 is connected to the inside surface of the upper panel 21; the connection manner can be, for example, a bonding connection, a snap-in connection, a plug-in connection, or a fastener connection; and in an embodiment, the connection is a bonding connection. A detachable connection, such as a snap-in connection, a plug-in connection, or the like, is formed between the second connection portion 52 and the fume gathering cover 4. In an embodiment, in order to facilitate detachment, the second connection portion 52 is rigidly connected to the fume gathering cover 4 by fasteners. The number of the first connection members 5 is not limited, but can be one or multiple. In the embodiment as shown in FIG. 2, two first connection members 5 are provided and located respectively on two sides of the upper panel 21.

The first connection portion 51 and the second connection portion 52 can be configured to be any structures, which can implement the connection between the upper panel 21 and the fume gathering cover 4. In an embodiment, in order to facilitate processing and assembly, as shown in FIG. 2, the first connection portion 51 and the second connection portion 52 are both plate-shaped and parallel to each other, and the first connection portion 51 and the second connection portion 52 are connected by a connection plate 53. In an embodiment, a side edge of the connection plate 53 is connected to an edge of the first connection portion 51, and an opposite side edge of the connection plate is connected to an edge of the second connection portion 52. In an embodiment, the first connection portion 51 and the second connection portion 52 extend relative to the connection plate 53 in opposite directions. Specifically, the connection plate 53 has a long plate-shaped structure, which extends along the side edge of the connection plate 53; a longer edge of the connection plate 53 and the first connection portion 51 are connected; and the opposite longer edge of the connection plate and the second connection portion 52 are connected. In an embodiment, two second connection portions 52 are provided and located respectively on two ends of the connection plate 53. In an embodiment, protrusion structures are further arranged on two shorter edges of the connection plate 53. The connection plate 53 can be respectively perpendicular to the first connection portion 51 and the second connection portion 52, or can be arranged to form an acute angle or an obtuse angle with the first connection portion 51 and the second connection portion 52. The connection manner that the first connection portion 51 and the second connection portion 52 are connected by the connection plate 53 can facilitate adjustment of the distance between the first connection portion 51 and the second connection portion 52, so as to fit the assembly of the first connection member 5 and the fume gathering cover 4.

Figure 5:
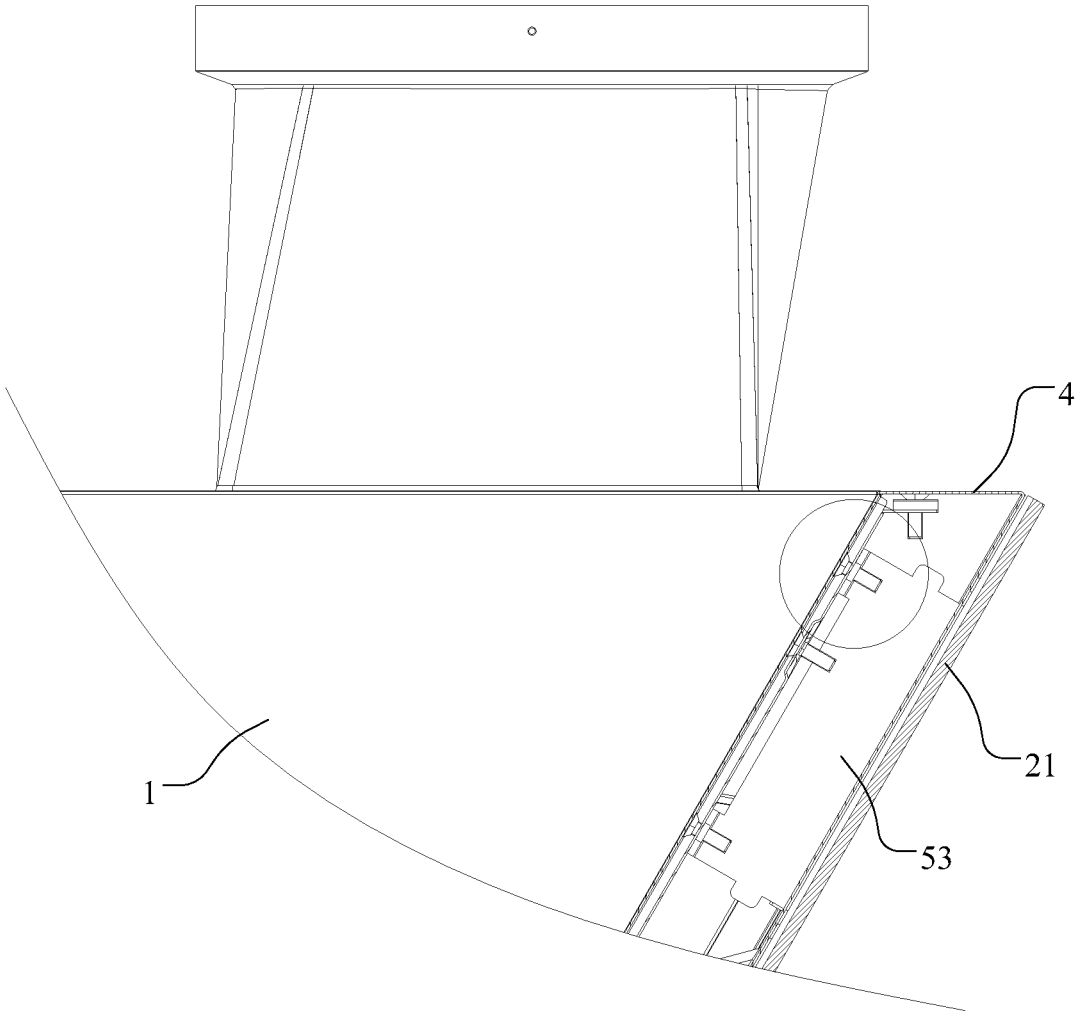
FIG. 5 is a schematic structural diagram illustrating the assembly of the upper panel and a fume gathering cover of the range hood shown in FIG. 1.
Figure 9:
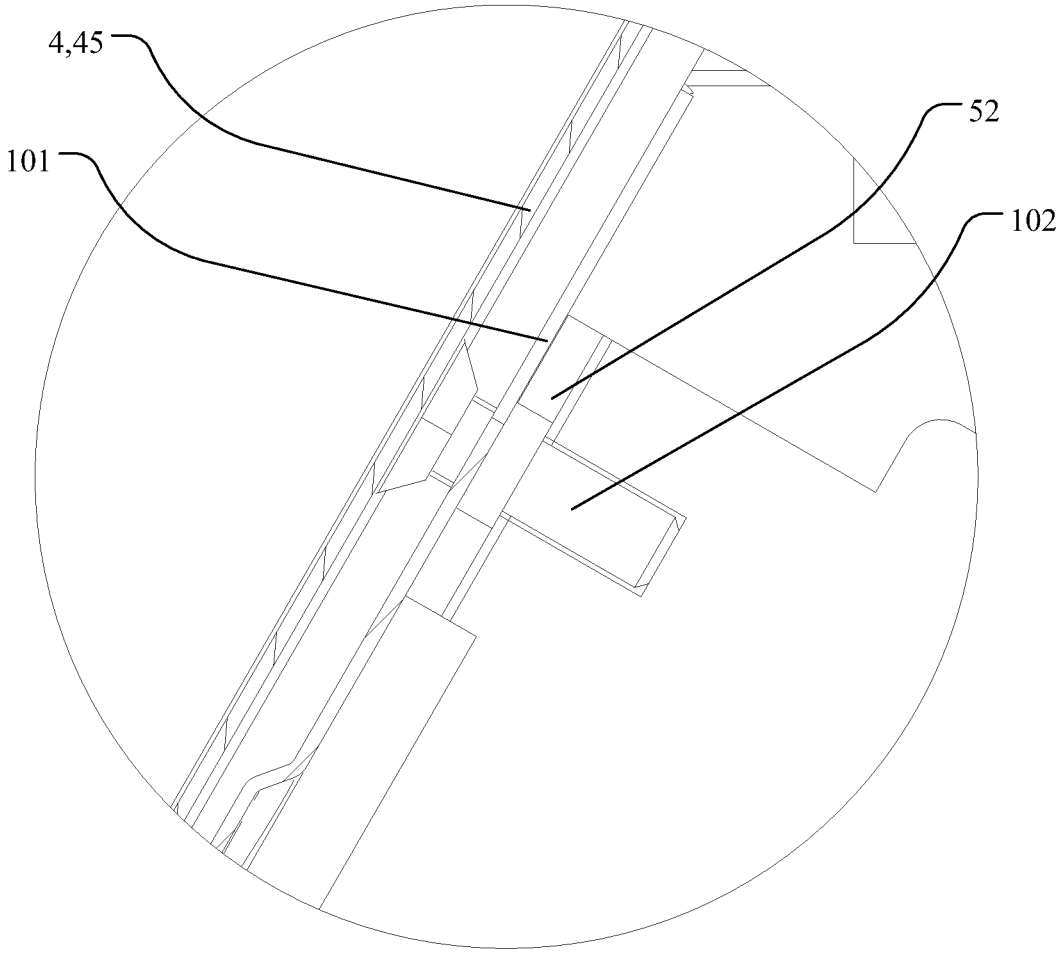
FIG. 9 is an enlarged diagram of a portion B shown in FIG. 5.

Further, an opening 41 is arranged on a side wall of the fume gathering cover 4. The second connection portion 52 and at least a portion of the connection plate 53 can pass through the opening 41 and penetrate into the interior of the fume gathering cover 4, and is connected to the interior of the fume gathering cover 4. Specifically, as shown in FIG. 5 and FIG. 9, a folded flange 101 is arranged on a side plate of the housing 1. The folded flange 101 is formed by being folded towards the exterior of the opening of the housing 1; a frame structure 45, is arranged at a rear side of the fume gathering cover 4, and the frame structure 45 covers a portion of the housing 1, which is proximate to the opening; the folded flange 101 and the frame structure 45 are fastened, for example, by a fastener 102, thereby fastening the fume gathering cover 4 on the housing 1; and the second connection portion 52 penetrating the interior of the fume gathering cover 4 and the frame structure 45 are also connected by the fastener 102. In an embodiment, the second connection portion 52 and the folded flange 101 are fixedly connected to the frame structure 45 by the same fastener 102, thereby improving the assembly efficient. In order to facilitate the assembly, the rigid connections between all parts are implemented by the fastener 102 at the rear side.

Further, as shown in FIG. 1, the fume gathering cover 4 is provided with an air inlet 42 corresponding to the position of the fan 3. In an embodiment, the fume gathering cover 4 is provided with an inner recess 43 recessed in a direction away from the fume inlet panel component 2. The air inlet 42 is arranged on an inner bottom of the inner recess 43, and in the radial direction of the fan 3, the edge of the air inlet 42 is located outside of the fan 3, thereby preventing the fume gathering cover 4 from interfering the removal of the fan 3. A first filtration structure 6 is arranged on the fume gathering cover 4. The first filtration structure 6 covers the air inlet 42 to filter the entering air. In an embodiment, the first filtration structure 6 is an oil filtering lattice 61. An installation rim 62 is provided on the periphery of the oil filtering lattice 61, and a detachable connection is formed between the installation rim 62 and the fume gathering cover 4, for example, the installation rim 62 is rigidly connected to the fume gathering cover 4 by a fastener. In an embodiment, the first filtration structure 6 is received in the inner recess 43 of the fume gathering cover 4, so that the structure of the range hood is more compact.

Further, the space between the upper panel 21 and the lower panel 22 forms the air inlet of the range hood. The range hood further includes a second filtration structure 7, which is disposed between the upper panel 21 and the lower panel 22 and corresponds to the position of the fume deflector 23. That is, when the fume deflector 23 is located in a second position (which will be described in detail below), the fume deflector 23 exactly covers the second filtration structure 7, which is configured to filter the air entering the air inlet of the range hood. The second filtration structure 7 can be, for example, a grid filter shown in FIG. 1.

In an embodiment, the inner recess 43 includes a first portion 431 corresponding to the position of the upper half of the fan 3, and a second portion 432 corresponding to the position of the lower half and the second filtration structure 7. A side wall 4311 of the first portion 431 forms a shape fitting the periphery of the fan 3 in the radial direction. A side wall 4321 of the second portion 432 forms a shape fitting the edge of the second filtration structure 7. The second filtration structure 7 is installed on the second portion 432. When the upper panel 21 is installed on the fume gathering cover 4, the upper panel 21 covers the first portion 431, therefore the upper panel 21 will interfere the removal of the fan 3, and the upper panel 21 needs to be opened when the fan 3 needs to be removed. In a preferred embodiment, the second filtration structure 7 is installed on a ball catch 44 on the fume gathering cover 4.

Further, the fume deflector 23 can be located in a first position of an opened state and a second position of a closed state. In the opened state, compared with the upper end, the lower end of the fume deflector 23 is farther away from the housing, that is, the fume deflector 23 is inclined and away from the housing 1 from top to down, thereby guiding the fume. In the closed state, the fume deflector 23, the upper panel 21 and the lower panel 22 are pieced together to form a flat outer surface of the fume inlet panel component 2, which on one hand ensures the completeness in appearance, and on the other hand can prevent foreign objects such as dust from entering into the range hood.

Figure 3:
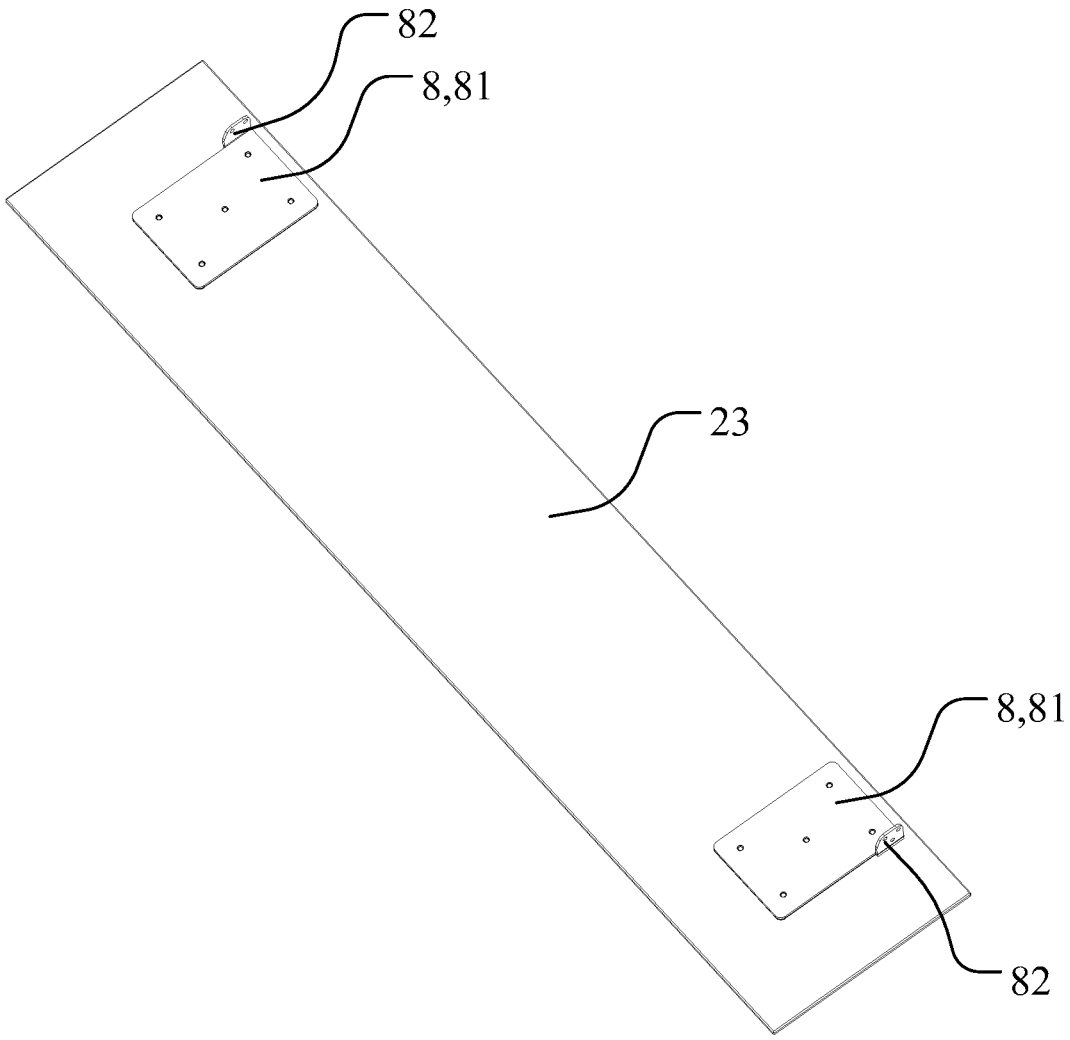
FIG. 3 is a schematic structural diagram illustrating an inside surface of a fume deflector of the range hood shown in FIG. 1.

The fume deflector 23 can be connected to the housing 1, or can be connected to the fume gathering cover 4, as shown in FIG. 1. In a preferred embodiment, the fume deflector 23 is connected to the fume gathering cover 4 by the second connection member 8. As shown in FIG. 3, the second connection member 8 includes a third connection portion 81 and a fourth connection portion 82. The third connection portion 81 is connected to the inside surface of the fume deflector 23, and the connection manner can be, for example, a bonding connection, a snap-in connection, a plug-in connection or a fastener connection. In an embodiment, the connection manner is a bonding connection. A detachable connection, such as a snap-in connection, a plug-in connection and the like, is formed by the fourth connection portion 82 and the fume gathering cover 4. In an embodiment, in order to facilitate the detachment, the fourth connection portion 82 is rigidly connected to the fume gathering cover 4 by a fastener. The number of the second connection members 8 is not limited, but can be one or multiple. In the embodiment shown in FIG. 3, two second connection members 8 are provided and located respectively on two sides of the fume deflector 23.

The third connection portion 81 and the fourth connection portion 82 can be any structures, which can implement the connection between the fume deflector 23 and the fume gathering cover 4. In an embodiment, in order to facilitate processing and assembly, as shown in FIG. 3, the third connection portion 81 and the fourth connection portion 82 are both plate-shaped structures. The fourth connection portion 82 is connected to an edge of the third connection portion 81. The fourth connection portion 82 and the third connection portion 81 can be perpendicular to each other, or can form an acute angle or an obtuse angle, thereby facilitating the assembly of the fourth connection portion 82 and the fume gathering cover 4.

Figure 4:
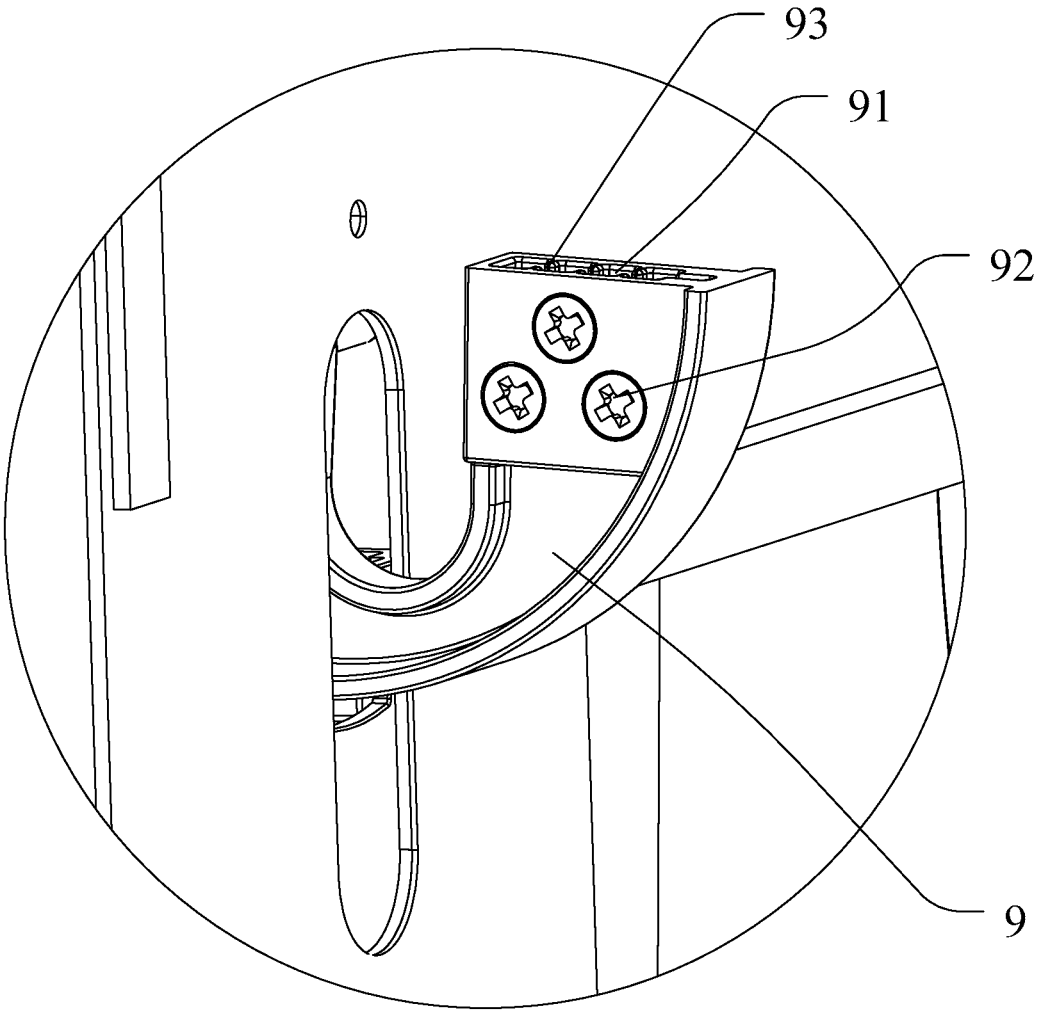
FIG. 4 is an enlarged diagram of a portion A shown in FIG. 1.

Further, the fume gathering cover 4 is provided with a retractable support 9. The fourth connection portion 82 is connected to the fume gathering cover 4 through the retractable support 9. Driven by a driving device (not shown in the figures), the retractable support 9 can move relative to the fume gathering cover 4, that is, the retractable support 9 can extend or retract relative to the fume gathering cover 4, so that the fume deflector 23 can switch between the first position and the second position. In a preferred embodiment, as shown in FIG. 4, the retractable support 9 is provided with a slot 91. The slot 91 is preferably arranged on an end surface of the retractable support 9. The fourth connection portion 82 is inserted into the slot 91, and is rigidly connected to the retractable support 9 through the fastener 92. In order to fix the orientation of the fume deflector 23, in an embodiment, three fasteners 92 are provided, and the three fasteners 92 are located at three vertexes of a triangle, so that the fume deflector 23 has a unique fixed installation orientation when installed on the retractable support 9. Of course, it should be understood that two fasteners 92 can be provided. Further, in order to position the fourth connection portion 82, a protrusion limit structure 93 is arranged on the side wall of the slot 91. The protrusion limit structure 93 can be, for example, a rib formed on the side wall of the slot 91. In an embodiment, the rib extends in the same direction as the fourth connection portion 82 is inserted. In an embodiment, the retractable support 9 is in a shape of a curved hook.

Further, an end member (not shown in the figures), for example, an end plate, is arranged at an end of the fan 3 away from the fume inlet panel component 2. A driving shaft of the driving device drives the end plate to rotate, thereby driving the fan 3 to rotate. The driving shaft of the driving device is connected to the end member by a fastener. For example, in the embodiment shown in FIG. 1, the fastener is a rotation nut 10. In order to facilitate the detachment of the fan 3, in an embodiment, the rotation nut 10 is provided detachably at a side of the end member, which is proximate to the fume inlet panel component 2.

In this way, when the fan 3 needs to be removed and cleaned, the following processes are performed sequentially:

detaching the fume deflector 23 from the retractable support 9;

detaching the second filtration structure 7 from the fume gathering cover 4;

detaching the upper panel 21 from the fume gathering cover 4;

detaching the first filtration structure 6 from the fume gathering cover 4; and rotating the rotation nut 10 to loose the fan 3, and removing the fan 3 from the air inlet 42.

Figure 7:
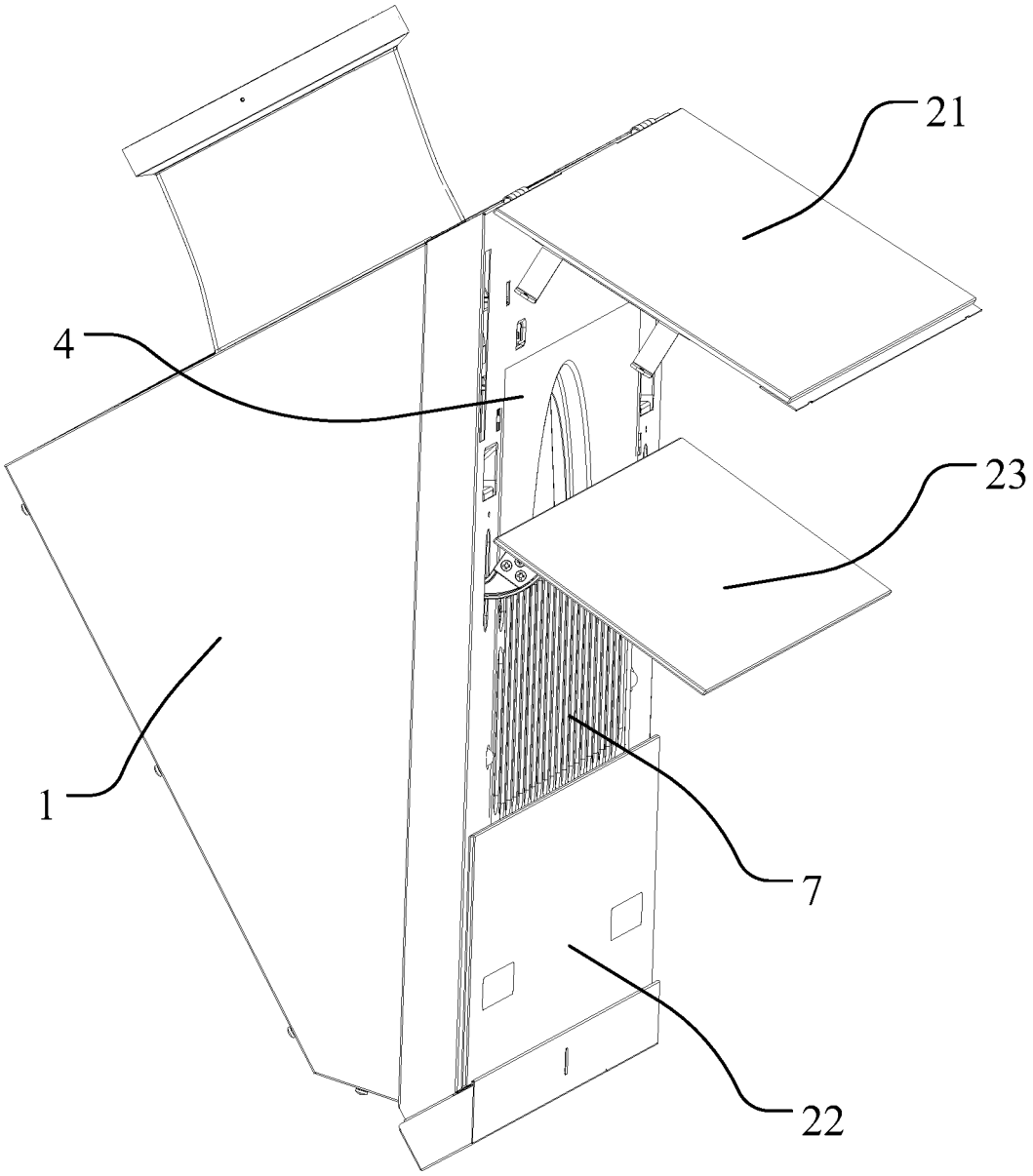
FIG. 7 is a schematic structural diagram of an upper panel in an opened state of the range hood shown in FIG. 6.
Figure 8:
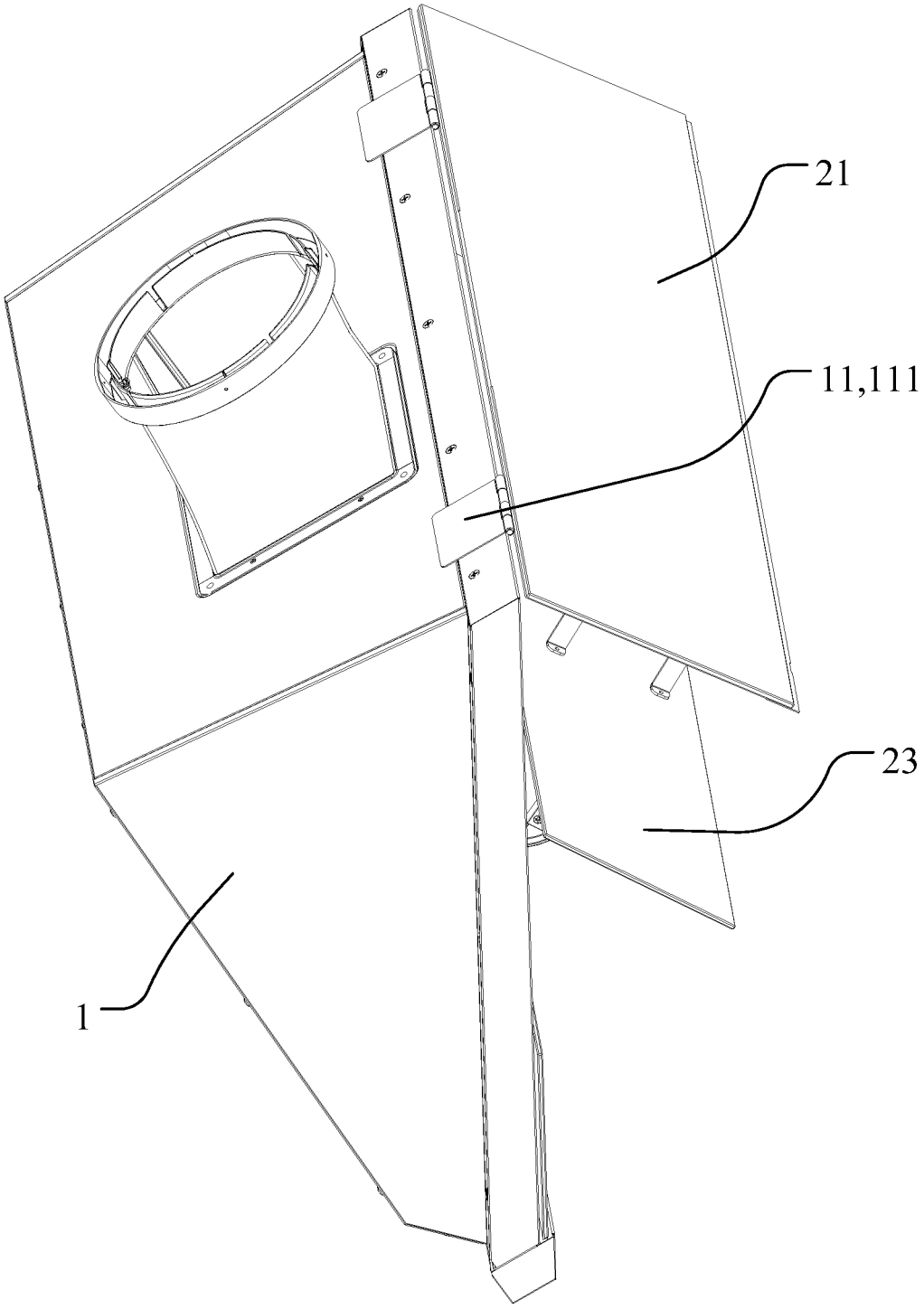
FIG. 8 is the schematic structural diagram from another view angle of FIG. 7.

It can be understood that the upper panel 21 is not limited to a detachable structure shown in FIG. 1. For example, the upper panel 21 shown in FIG. 6 in the embodiment can be configured to be a turnable structure. In an embodiment, the upper panel 21 is hinged on the housing 1. In an embodiment, a top edge of the upper panel 21 is hinged on the housing 1, and in this way, as shown in FIG. 7, the upper panel 21 can rotate around a hinge pivot, so that the upper panel 21 turns to a position not interfering the removal of the fan 3. In a specific embodiment, the upper panel 21 is connected to the housing 1 through a hinge structure 11. A first hinge (not shown in the figures) of the hinge structure 11 is connected to the upper panel 21, and a second hinge 111 is connected to the housing 1. In an embodiment, as shown in FIG. 8, the second hinge 111 is connected to the top panel of the housing 1, and the first hinge and the second hinge 111 are hinged by the hinge pivot, thereby realizing a hinge joint between the upper panel 21 and the housing 1. In an alternative embodiment, the hinge pivot can also be arranged on the housing 1, so that the upper panel 21 can rotate around the hinge pivot. The housing 1 is further provided with a slide rail allowing the upper panel to slide. When the upper panel 21 is turned around the hinge pivot to a specific angle, the upper panel 21 and the slide rail join together, and the upper panel 21 slides to an upper portion of the housing 1 along the slide rail, so as to position the upper panel 21 at the upper portion of the housing 1, thereby facilitating the removal of the fan 3. Other structures of the range hood are similar to the embodiment shown in FIG. 1, which are not to be described herein again. Of course, it can be understood that the upper panel 21 can also be hinged with the fume gathering cover 4. Moreover, the upper panel 21 can also be configured to be an up-down slideable structure. When the fan 3 needs to be removed, the upper panel 21 slides upwards, so as to not interfere the removal of the fan 3.

The fume inlet panel component 2 of the range hood provided in the present disclosure is configured to enable the region of the opening of the housing 1, which is corresponding to the fan 3, to be opened. Therefore, when the fan 3 and the inner side wall of the volute need to be cleaned by the user, the user is only required to open the fume inlet panel component 2, then the fan 3 can be easily removed from the side where the smoke inlet panel component 2 is located, thereby facilitating the cleaning of the removed fan 3 and the cleaning of the inner side wall of the volute by accessing the interior of the volute, thereby ensuring the extraction capacity of the range hood, and prolonging the service life of the range hood.

Those skilled in the art can easily understand that, the above-mentioned preferred solutions can be arbitrarily combined and superimposed if no conflicts occur.

It should be understood that the above-mentioned implementations are merely exemplary and not limiting, and various obvious or equivalent modifications and replacements made by those skilled in the art with respect to the above details without departing from the basic principles of the present disclosure, are all included in the scope of the appended claims of this disclosure.

What is claimed is:

1. A range hood, wherein the range hood comprises a housing having an opening, and a fume inlet panel component arranged on the housing; the fume inlet panel component is arranged at the opening of the housing; a fan is arranged in an inner cavity of the housing; and the fume inlet panel component is configured to enable at least a region of the opening of the housing, which corresponds to the fan, to open, so that the fan can be removed from the region;

the fume inlet panel component comprises a plurality of panels;

the plurality of panels comprises an upper panel, a lower panel, and a fume deflector located between the upper panel and the lower panel;

the upper panel is configured to be an openable structure; the fume deflector is configured to be a detachable structure;

a fume gathering cover is arranged at the opening of the housing; the fume gathering cover is disposed on an inner side of the fume inlet panel component; and the fume deflector is connected to the fume gathering cover.

2. The range hood of claim 1, wherein the openable structure is a detachable structure, or the openable structure is a turnable structure, or the openable structure is a slideable structure.

3. The range hood of claim 1, wherein the fume deflector has an opened state and a closed state; in the opened state, compared with an upper end of the fume deflector, a lower end of the fume deflector is farther away from the housing; and in the closed state, the fume deflector, the upper panel and the lower panel are pieced together to form a flat outer surface of the fume inlet panel component.

4. The range hood of claim 1, wherein the upper panel is connected to the fume gathering cover by a first connection member; the first connection member comprises a first connection portion and a second connection portion; the first connection portion is connected to an inside surface of the upper panel; the second connection portion is connected to the fume gathering cover; and the fume deflector is connected to the fume gathering cover by a second connection member; the second connection member comprises a third connection portion and a fourth connection portion; the third connection portion is connected to an inside surface of the fume deflector; and the fourth connection portion is connected to the fume gathering cover.

5. The range hood of claim 4, wherein the first connection portion is rigidly connected to the upper panel by bonding;

the second connection portion is rigidly connected to the fume gathering cover by a fastener; the third connection portion is rigidly connected to the fume deflector by bonding; and the fourth connection portion is rigidly connected to the fume gathering cover by a fastener.

6. The range hood of claim 5, wherein a retractable support is arranged on the fume gathering cover; the retractable support is provided with a slot; the fourth connection portion is inserted in the slot and is rigidly connected to the retractable support by a fastener.

7. The range hood of claim 4, wherein the first connection portion and the second connection portion are both plate-shaped; the first connection portion is parallel to the second connection portion; and the first connection portion and the second connection portion are connected by a connection plate;

and the third connection portion and the fourth connection portion are both plate-shaped; and the fourth connection portion is connected to an edge of the third connection portion.

8. The range hood of claim 1, wherein the fume gathering cover is provided with an air inlet corresponding to a position of the fan, and an edge of the air inlet is located outside of the fan in radial directions of the fan.

9. The range hood of claim 8, wherein the range hood further comprises a first filtration structure, and the first filtration structure is arranged on the fume gathering cover and covers the air inlet.

10. The range hood of claim 9, wherein an inner recess recessed in a direction away from the fume inlet panel component is disposed on the fume gathering cover; the air inlet is arranged on an inner bottom of the inner recess; and the first filtration structure is received in the inner recess.

11. The range hood of claim 10, wherein the range hood further comprises a second filtration structure; the inner recess comprises a first portion corresponding to a position of an upper half of the fan, and a second portion corresponding to a position of a lower half of the fan and the second filtration structure; a side wall of the first portion forms a shape fitting a peripheral of the fan in the radial directions; a side wall of the second portion forms a shape fitting an edge of the second filtration structure; and the second filtration structure is arranged on the second portion.

12. The range hood of claim 11, wherein when the upper panel is arranged on the fume gathering cover, the upper panel covers the first portion.

13. The range hood of claim 1, wherein a hinge joint is formed between an edge of the upper panel and the fume gathering cover, or formed between an edge of the upper panel and the housing.

14. The range hood of claim 1, wherein the range hood further comprises a driving device configured to drive the fan; an end of the fan, which is away from the fume inlet panel component, is provided with an end member; the driving device is connected to the end member by a fastener; and the fastener is configured to be detachable from a side of the end member, which is proximate to the fume inlet panel component.

15. The range hood of claim 1, wherein the upper panel is connected to the fume gathering cover by a first connection member; the first connection member comprises a first connection portion and a second connection portion; the first connection portion is connected to an inside surface of the upper panel; the second connection portion is connected to the fume gathering cover; or the fume deflector is connected to the fume gathering cover by a second connection member; the second connection member comprises a third connection portion and a fourth connection portion; the third connection portion is connected to an inside surface of the fume deflector; and the fourth connection portion is connected to the fume gathering cover.

16. The range hood of claim 4, wherein the first connection portion is rigidly connected to the upper panel by bonding; or the second connection portion is rigidly connected to the fume gathering cover by a fastener; or the third connection portion is rigidly connected to the fume deflector by bonding; or the fourth connection portion is rigidly connected to the fume gathering cover by a fastener.

17. The range hood of claim 4, wherein the first connection portion and the second connection portion are both plate-shaped; the first connection portion is parallel to the second connection portion; and the first connection portion and the second connection portion are connected by a connection plate;

or the third connection portion and the fourth connection portion are both plate-shaped; and the fourth connection portion is connected to an edge of the third connection portion.

18. A range hood, wherein the range hood comprises a housing having an opening, and a fume inlet panel component arranged on the housing; the fume inlet panel component is arranged at the opening of the housing; a fan is arranged in an inner cavity of the housing; and the fume inlet panel component is configured to enable at least a region of the opening of the housing, which corresponds to the fan, to open, so that the fan can be removed from the region;

the fume inlet panel component comprises a plurality of panels;

the plurality of panels comprises an upper panel, a lower panel, and a fume deflector located between the upper panel and the lower panel;

the upper panel is configured to be an openable structure; the fume deflector is configured to be a detachable structure;

a fume gathering cover is arranged at the opening of the housing; the fume gathering cover is disposed on an inner side of the fume inlet panel component; and the upper panel is connected to the fume gathering cover.

* * * * *